US006506016B1

(12) United States Patent
Wang

(10) Patent No.: US 6,506,016 B1
(45) Date of Patent: Jan. 14, 2003

(54) ANGEL WING SEALS FOR BLADES OF A GAS TURBINE AND METHODS FOR DETERMINING ANGEL WING SEAL PROFILES

(75) Inventor: John Zhiqiang Wang, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/987,696

(22) Filed: Nov. 15, 2001

(51) Int. Cl.[7] ..... F01D 11/02

(52) U.S. Cl. ..... 415/173.7; 416/193 A; 416/239

(58) Field of Search ..... 415/173.7, 174.5; 416/239, 193 A

(56) References Cited

U.S. PATENT DOCUMENTS 5,924,843 A * 7/1999 Staub et al. ..... 415/115
6,042,951 A * 3/2000 Kojima et al. ..... 428/633
6,189,891 B1 * 2/2001 Tomita et al. ..... 277/414

* cited by examiner

*Primary Examiner*—Edward K. Look
*Assistant Examiner*—Ninh Nguyen
(74) *Attorney, Agent, or Firm*—Nixon & Vanderhye

(57) ABSTRACT

A gas turbine has buckets rotatable about an axis, the buckets having angel wing seals. The seals have outer and inner surfaces, at least one of which, and preferably both, extend non-linearly between root radii and the tip of the seal body. The profiles are determined in a manner to minimize the weight of the seal bodies, while maintaining the stresses below predetermined maximum or allowable stresses.

19 Claims, 6 Drawing Sheets

ANGEL WING SEALS FOR BLADES OF A GAS TURBINE AND METHODS FOR DETERMINING ANGEL WING SEAL PROFILES

This invention was made with Government support under Contract No. DE-FC21-95MC31176 awarded by the Department of Energy. The Government has certain rights in this invention.

BACKGROUND OF THE INVENTION

The present invention relates to angel wing seals formed on the platforms of blades of a gas turbine rotor for sealing between the blades and nozzles and particularly relates to the profiles of the angel wing seals and methods of determining the profiles of the angel wing seals enabling a minimization of weight while maintaining seal stresses below a predetermined maximum or allowable stress.

Angel wing seals are axial extensions of a turbine rotor blade, i.e., a bucket, which form a seal by overlapping with nozzle seal lands forming part of the fixed component of a gas turbine. The angel wing seals inhibit ingestion of hot gases from the flowpath into gas turbine wheel spaces. Typically, angel wing seals are cast integrally as part of the blade or bucket. Conventional angel wing seals employ a linear profile in which the radially outer and inner surfaces of the seal form a wedge-shaped angle typically extending between the tip of the angel wing seals and fillets at the root of the seal with the blade platform. These linear profiles generate a stress distribution which is maximum at the root of the seal. Because dimensional designs are dictated by maximum stresses, extra material is necessary to ensure that maximum stress concentrations remain below an allowable stress level. There is a need, however, for angel wing seals which not only have stress concentrations at or below the maximum stress level but also which will provide a seal profile of minimum weight.

BRIEF DESCRIPTION OF THE INVENTION

In accordance with a preferred embodiment of the present invention, there is provided angel wing seals and a method of determining the profile of angel wing seals which, for a given set of design parameters, identifies an angel wing section profile which minimizes the weight of the seals while maintaining the stresses in the seals below a maximum or allowable stress. Thus, for known design parameters and by iterative processes, maximum and allowable stresses, as well as the thickness along the length of the angel wing seal can be ascertained for those given parameters. Additionally, using further iterative processes, the profile of the radially inner and outer surface portions between the root fillets of the seal and the tip of the seal can be determined such that the angel wing seal weight is minimized while maintaining bending stresses at or below the maximum or allowable bending stress.

In a preferred embodiment according to the present invention, there is provided in a gas turbine having a rotor rotatable about an axis, blades carried by the rotor for rotation therewith and nozzles, a seal between each rotor blade and nozzles for inhibiting ingestion of hot gas from a hot gas flow through the turbine into turbine wheel spaces, comprising a seal body extending from a platform of the blade to a cantilevered tip thereof and generally axially toward lands on the nozzles, the seal body having radially outer and inner surfaces, each including a root fillet and surface portions between the fillet and the tip, one of the radially outer and inner surface portions extending non-linearly and disposed between the fillet and the tip.

In a further preferred embodiment according to the present invention, there is provided in a gas turbine having a rotor rotatable about an axis, blades carried by the rotor for rotation therewith, nozzles and seals between each rotor blade and the nozzles for inhibiting ingestion of hot gas from a hot gas flow path through the turbine into turbine wheel spaces, each seal having an upturn at a cantilevered tip thereof, a method of determining a profile of the seal, comprising the steps of for a given radial location of the seal relative to the rotor axis, material density of the seal, rotational velocity of the rotor, and thickness and width of the seal, determining a thickness profile along a length of the seal to maintain stresses along the seal below a predetermined allowable stress and to reduce the weight of the seal to a minimum.

In a further preferred embodiment according to the present invention, there is provided in a gas turbine having a rotor rotatable about an axis, blades carried by the rotor for rotation therewith, nozzles and seals between each rotor blade and the nozzles for inhibiting ingestion of hot gas from a hot gas flow path through the turbine into turbine wheel spaces, each seal having an upturn at a cantilevered tip thereof, a method of determining a profile of the seal, comprising the steps of, for a given radial location of the seal relative to said rotor axis, material density of the seal, rotational velocity of the rotor, and thickness and width of the seal, determining the maximum bending stress at selected locations along a length of the seal body and determining a thickness profile along a length of the seal body having minimum weight for the determined maximum bending stress or an allowable bending stress less than the maximum bending stress.

In a further preferred embodiment according to the present invention, there is provided in a gas turbine having a rotor rotatable about an axis, blades carried by the rotor for rotation therewith, nozzles and seals between each rotor blade and the nozzles for inhibiting ingestion of hot gas from a hot gas flow path through the turbine into turbine wheel spaces, each seal having an upturn at a cantilevered tip thereof, a method of determining a profile of the seal, comprising the steps of, for a given radial location of the seal relative to the rotor axis, material density of the seal, rotational velocity of the rotor, and thickness and width of the seal, determining the maximum bending stress $S_{max}$ at selective locations along a length of the seal conforming to the equation $$S_{\max} = \frac{6z_0\rho\omega^2}{h^2(x)}\left[ab\left(x-\frac{a}{2}\right)+\int_0^x h(\xi)(x-\xi)\,d\xi\right]$$

wherein the mass of the seal is determined by $$M_a = \rho W\left(ab+\int_0^L h(x)\,dx\right)$$

and wherein $Z_0$ is the radial location of the seal body centerline relative to the axis of rotation of the rotor, $\omega$ is the angular velocity of the rotor, $\rho$ is the density of material forming the seal body, a is the width of the upturn, b is the height of the upturn and x is the distance from a tip of the seal in a direction parallel to the rotor axis to a location measured from the tip.

DETAILED DESCRIPTION OF THE INVENTION

Figure 1:
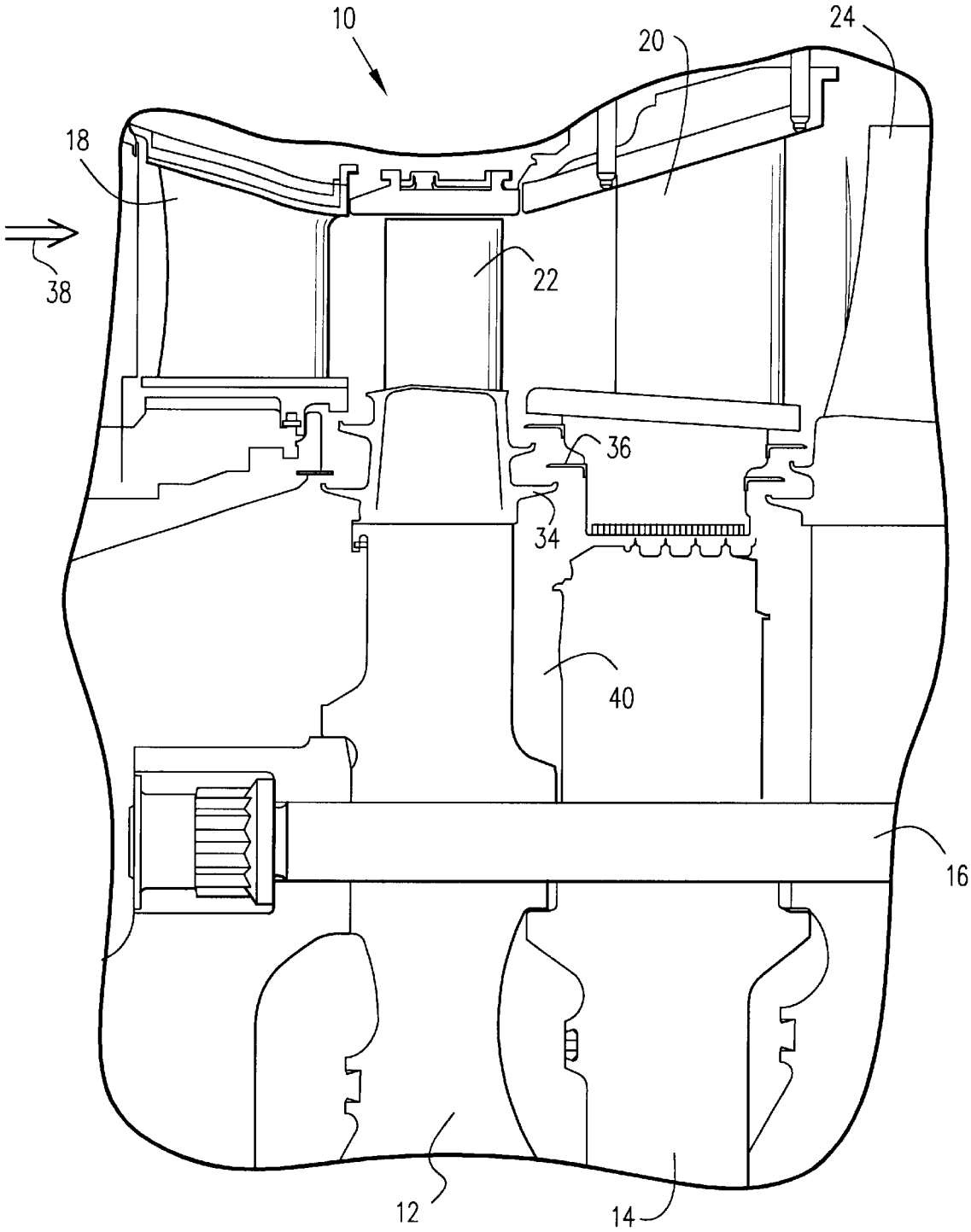
FIG. 1 is a fragmentary schematic illustration of a cross-section of a portion of a turbine.

Referring now to the drawing figures, particularly to FIG. 1, there is schematically illustrated a section of a gas turbine, generally designated 10, including a motor having axially spaced rotor wheels 12 and spacers 14 joined one to the other by a plurality of circumferentially spaced, axially extending bolts 16. The turbine includes various stages having nozzles, for example, first-stage nozzles 18 and second-stage nozzles 20 comprised of a plurality of circumferentially spaced stator blades. Between the nozzles and rotating with the rotor are a plurality of rotor blades, the first and second-stage rotor blades 22 and 24, respectively, being illustrated.

Figure 2:
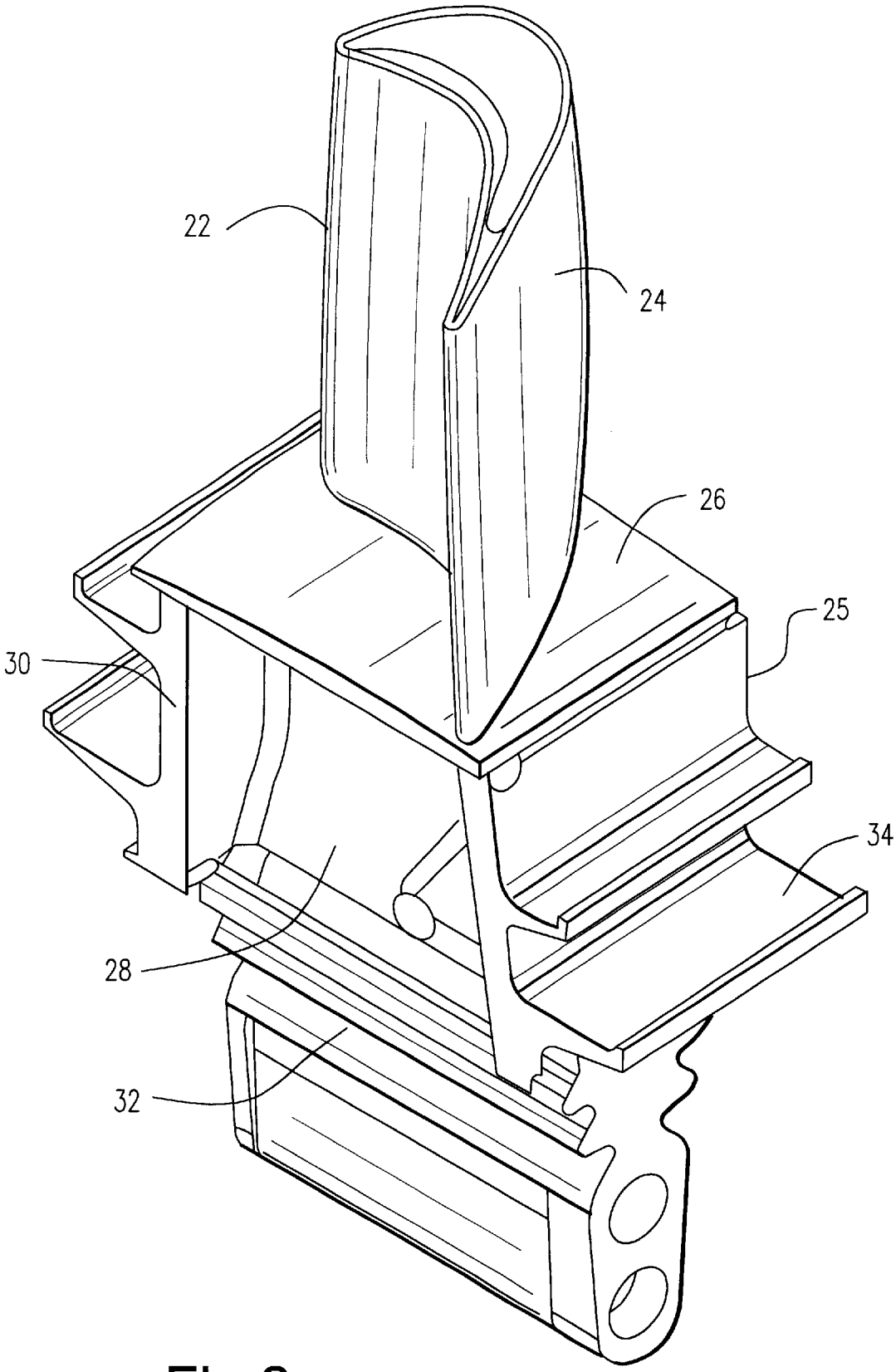
FIG. 2 is an enlarged perspective view of a turbine blade.
Figure 3:
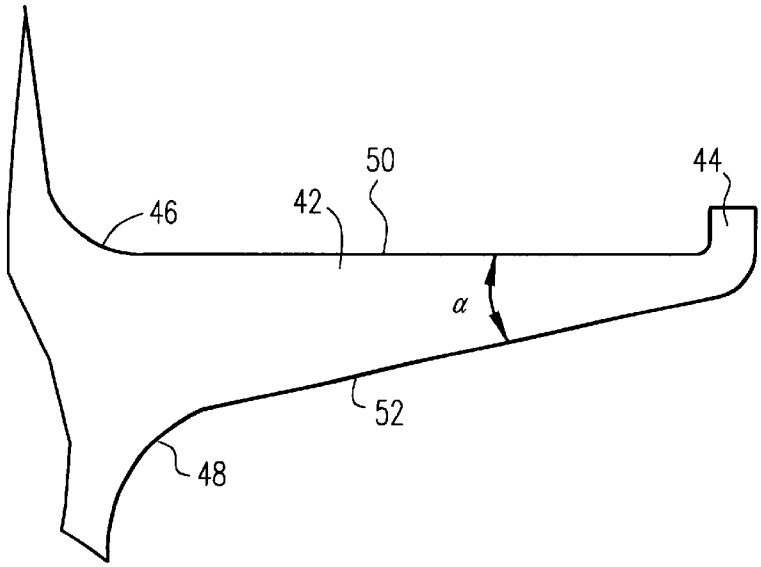
Fig.3 (PRIOR ART)
FIG. 3 is a schematic illustration of the profile of an angel wing seal according to the prior art.
Figure 4:
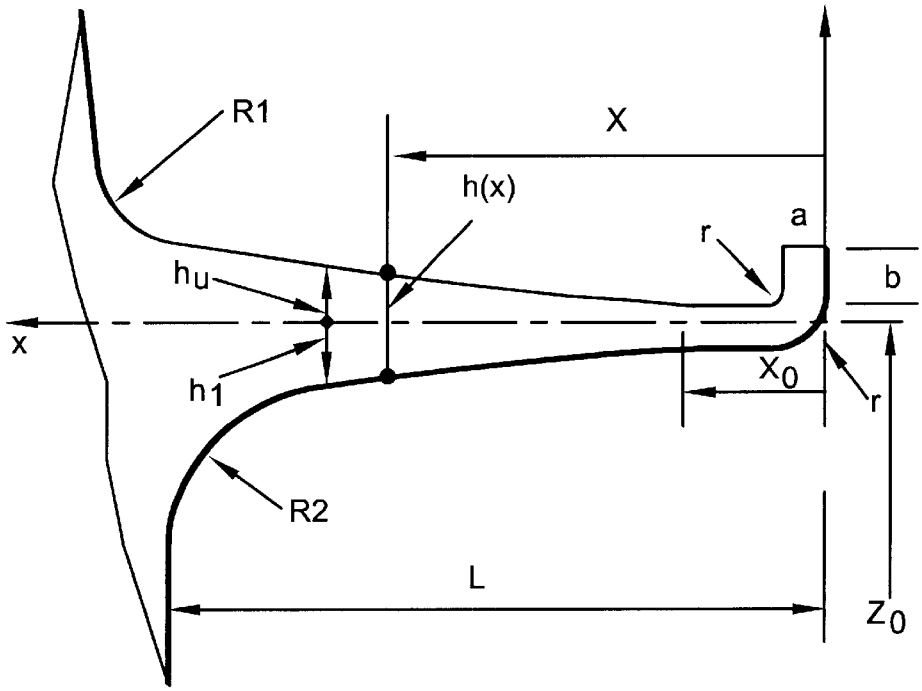
FIG. 4 is a diagram of an angel wing seal illustrating a coordinate system useful in describing the profile of an angel wing seal according to the present invention.

Each rotor blade, for example, the rotor blade 22 illustrated in FIG. 2, includes an airfoil 24 mounted on a shank 25 including a platform 26 and a shank pocket 28 having integral cover plates 30 and a dovetail 32 for connection with generally corresponding dovetail slots formed on the rotor wheel 12. The bucket 22 is typically integrally cast and includes axially projecting angel wing seals 34. The seals 34 cooperate with lands 36 formed on the adjacent nozzles to limit ingestion of the hot gases flowing through the hot gas path, generally indicated by the arrow 38 in FIG. 1, from flowing into the wheel spaces 40. Typically, the angel wing seals include an angel wing body 42 (FIG. 3), an upturn or tip 44 at its distal end, upper and lower angel wing root blends indicated 46 and 48, respectively, and upper and lower seal body surfaces 50 and 52, respectively. Conventionally, the upper and lower surfaces 50 and 52 are linear surfaces extending from the root blend to the tip 44, typically with the upper surface 50 having an arcuate surface concentric about the axis of rotation of the rotor.

In accordance with a preferred embodiment of the present invention, there is provided angel wing seals having profiles which minimize the weight of the seals while maintaining the stresses in the seals below a maximum or allowable stress. Additionally, for known design parameters and through iterative processes, the profile of the inner and outer surfaces are determined such that the weight of the angel wing seals is minimized, while maintaining bending stresses at or below maximum or allowable bending stresses. To accomplish the foregoing and, upon a review of FIG. 3, the maximum bending stress $S_{max}$ at any cross-section spanning a distance x in a direction axially from the angel wing tip toward the blade can be determined by the following Equation (1).

$$S_{\max} = \frac{6z_0\rho\omega^2}{h^2(x)}\left[ab\left(x-\frac{a}{2}\right)+\int_0^x h(\xi)(x-\xi)\,d\xi\right] \quad (x>a) \tag{1}$$

wherein $Z_0$ is the radial location of the angel wing seal body centerline relative to the axis of rotation of the rotor;

ω is the angular velocity of said rotor;

ρ is the density of material forming the angel wing;

a is the width of said upturn;

b is the height of said upturn;

x is the distance from the tip in a direction parallel to the rotor axis to a location measured from the tip.

The mass of the angel wing can be expressed as follows in Equation (2):

$$M_a = \rho W\left(ab+\int_0^L h(x)\,dx\right) \tag{2}$$

wherein

L is the axial length of the angel wing (in);

W is the tangential width of angel wing (in).

In the design of angel wing seals, the maximum stress is often equated to the allowable stress, hence Equation (3):

$$S_{max}=S_{all} \tag{3}$$

It can be shown that when the thickness $h_i$ at a given section is determined through the following iteration, the angel wing weight in Equation (3) will be at its minimal while maintaining the bending stress in Equation (1) to satisfy the design criteria in Equation (3). It needs to be noted that when deriving Equation (4) below, the term $-a^2b/2*6z_0\rho\omega^2/h^2(x)$ in Equation (1) is neglected to simplify the derivation. This simplification renders the resulting stress about a few percentage points higher than that if the term was kept (note both a and b are small compared to angel wing length L). Therefore, the simplification gives a slight conservatism in the solution given in Equation (4).

$$h_o=h_{min}\quad x\leq x_o$$

$$h_{i+1} = h_i + \frac{h_{\min}}{\lambda_1^2 h_i}\left(\sqrt{\lambda_1^2+\lambda_2^2}+\frac{H_{sum}^{(i)}}{h_{\min}^2}\Delta x\right)\Delta x \quad x>x_o \tag{4}$$

wherein $$x_o = \left(\sqrt{\lambda_1^2+\lambda_2^2}-\lambda_2\right)h_{\min} \tag{5}$$

$$\lambda_1 = \sqrt{\frac{S_{all}}{3h_{\min}z_0\rho\omega^2}} \tag{6}$$

$$\lambda_2 = \frac{ab}{h_{\min}^2} \tag{7}$$

$$H_{sum}^{(i)} = \sum_{k=0}^{i} h_k = h_0+h_1+h_2+\ldots+h_i \tag{8}$$

$$\Delta x=(L-x_0)/n \tag{9}$$

and wherein $Z_0$ is the radial location of the seal body centerline relative to the axis of rotation of the rotor;

$\omega$ is the angular velocity of said rotor;

$\rho$ is the density of material forming said seal body;

a is the width of said upturn;

b is the height of said upturn;

$h_{min}$ is the minimum thickness of an angel wing determined by other design considerations, e.g., castability;

x is the distance from the tip in a direction parallel to the rotor axis to a location measured from the tip;

$x_o$ is the distance from tip within which the thickness is to be maintained constant;

$H_{sum}^{(i)}$ is the summation of the thicknesses of said seal body at the iterative points h at each distance x;

L is the axial length of the seal body; and n is the number of points used to calculate the thickness and, hence, profile of the seal body.

The section height h(x) in Equation (4) can be used to determine the angel wing's radially outer and inner surface portion locations, $h_u(x)$ and $h_1(x)$ as follows:

$$h_u(x) = \frac{h_{\min}}{2} + \alpha(h(x) - h_{\min}) \tag{10a}$$

$$h_l(x) = -\frac{h_{\min}}{2} - (1-\alpha)(h(x) - h_{\min}) \tag{10b}$$

wherein $h_u(x)$ is the height of the outer surface portion of the angel wing seal body relative to the centerline of the angel wing (a bisector of the minimum section $h_{min}$)

$h_1(x)$ is the height of the inner surface portion of the angel wing seal body relative to the centerline of the angel wing (a bisector of the minimum section $h_{min}$)

$\alpha$ is a function of the pro portion of the distances of the outer and inner surface portions relative to a bisector of the seal body in the x direction.

These equations can be replaced, respectively, as follows:

$$h_{u_i} = \frac{h_{\min}}{2} + \alpha(h_i - h_{\min}) \tag{11}$$

$$h_{l_i} = \frac{-h_{\min}}{2} - (1-\alpha)(h_i - h_{\min}) \tag{12}$$

wherein $h_{u_i}$ is the height of the outer surface of the seal relative to a bisector of the minimum section $h_{min_i}$ at the $i^{th}$ point with a distance of $i \cdot \Delta x$ from the tip;

$h_1$ is the total thickness at the $i^{th}$ point with a distance of $i \cdot \Delta x$ from the tip;

$\alpha$ is a function of the proportion of the distances of the outer and inner surface portions relative to a bisector of the seal body in the x direction;

$h_{l_i}$ is the height of the inner surface of the seal relative to a bisector of the minimum section $h_{min_i}$ at the $i^{th}$ point with a distance of $i \cdot \Delta x$ from the tip;

i is an iterative series of x distances from the tip of the angel wing seal used during the iterative process.

Figure 5:
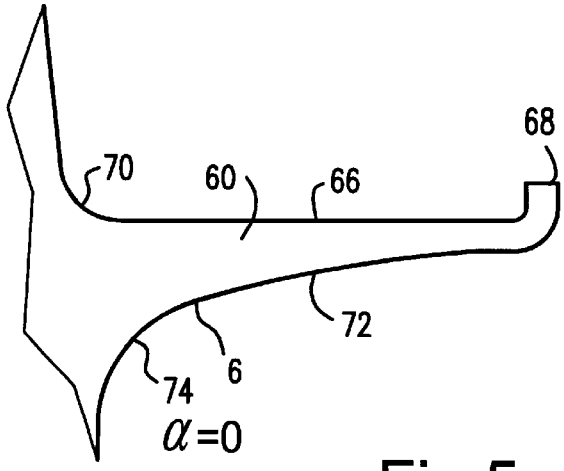
FIGS. 5, 6 and 7 are schematic illustrations of various viable profiles of angel wing seal bodies according to the present invention.
Figure 6:
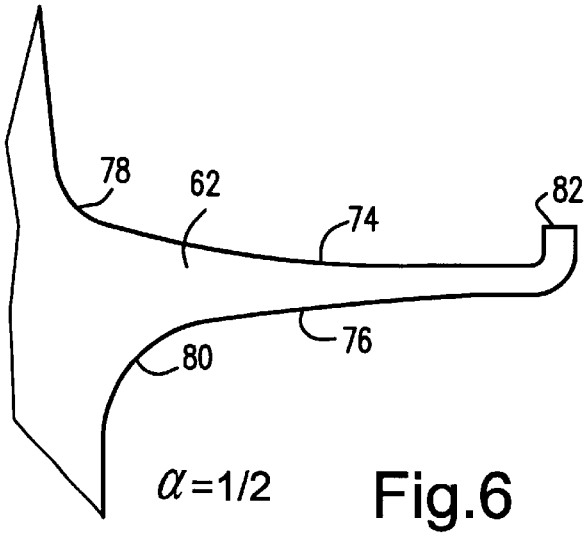
Figure 7:
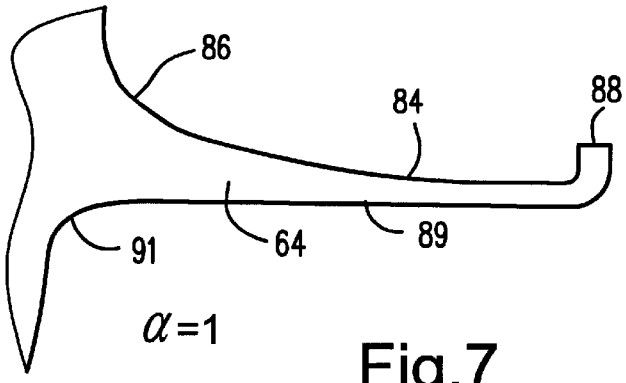
Figure 9:
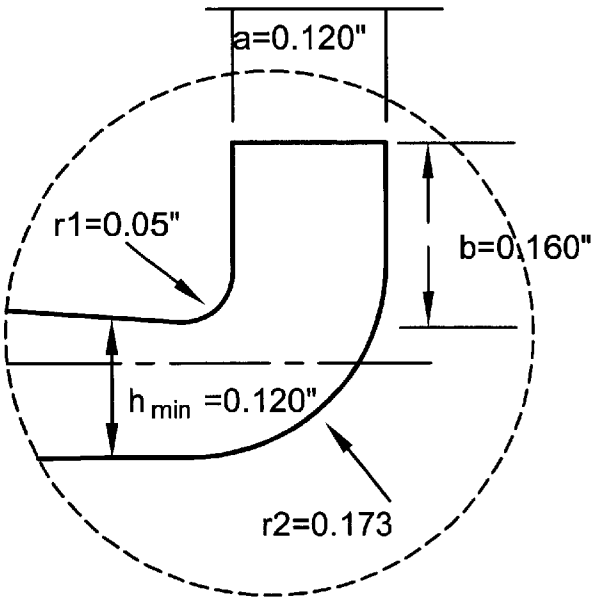
FIG. 9 is an enlarged portion of the tip of the angel wing body illustrated in FIG. 8.

FIGS. 5, 6 and 7 show three angel wing seals 60, 62, 64 having profiles at $\alpha$=0, $\alpha$=½ and $\alpha$=1.0, respectively. The upper surface 66 of seal 60 is linearly extending between the tip 68 and the fillet 70 while the lower surface 72 is curvilinear between tip 68 and a lower fillet 72. In the seal 62 of FIG. 6, the upper and lower surfaces 74 and 76, respectively, between the fillets 78 and 80 and tip 82 are curvilinear. In the seal 64 of FIG. 7, the upper surface 84 between the fillet 86 and tip 88 is curvilinear and the lower surface 89 between the fillet 91 and tip 88 is linear. Compared to the case at $\alpha$=½, i.e., a symmetry of the upper and lower surfaces about the angel wing seal centerline parallel to the axis of rotation, when $\alpha$<½, the stress magnitude at the outer surface (compressive) will decrease slightly, while the stress magnitude of the inner surface (tensile) will increase slightly. The opposite effect occurs when $\alpha$>½. Absent from other structural considerations, $\alpha$=½ is preferred due to considerations of castability of the blade including the angel wing seal body. As illustrated in FIGS. 5–7, at least one of the radially inner and outer surfaces between the tip and the root fillets extends non-linearly and preferably both.

It is noted that for a given set of design parameters, a, b, $\omega$, $\rho$, $z_0$, $h_{min}$, L, W, the profile is dependent on the following three independent parameters:

$$\lambda_1\sqrt{h_{\min}};\lambda_2 h_{min}^2;h_{min} \tag{13}$$

After the angel wing body profile is determined, to reduce stress concentration, the angel wing body is blended with the bucket cover-plate with transitional curves such as blend radii $R_1$ and $R_2$. Increasing blend radius reduces the stress concentration but increases weight. Weight increase is proportional to the geometric mean of radii R1 and R2. Therefore, the determination of the root blend radii needs to be the minimal to maintain the stresses at and near the root at an allowable level. The root radii can be determined through, for example, a Design of Experiment (DOE) type of study or use the Design Optimization function in ANSYS®.

Figure 8:
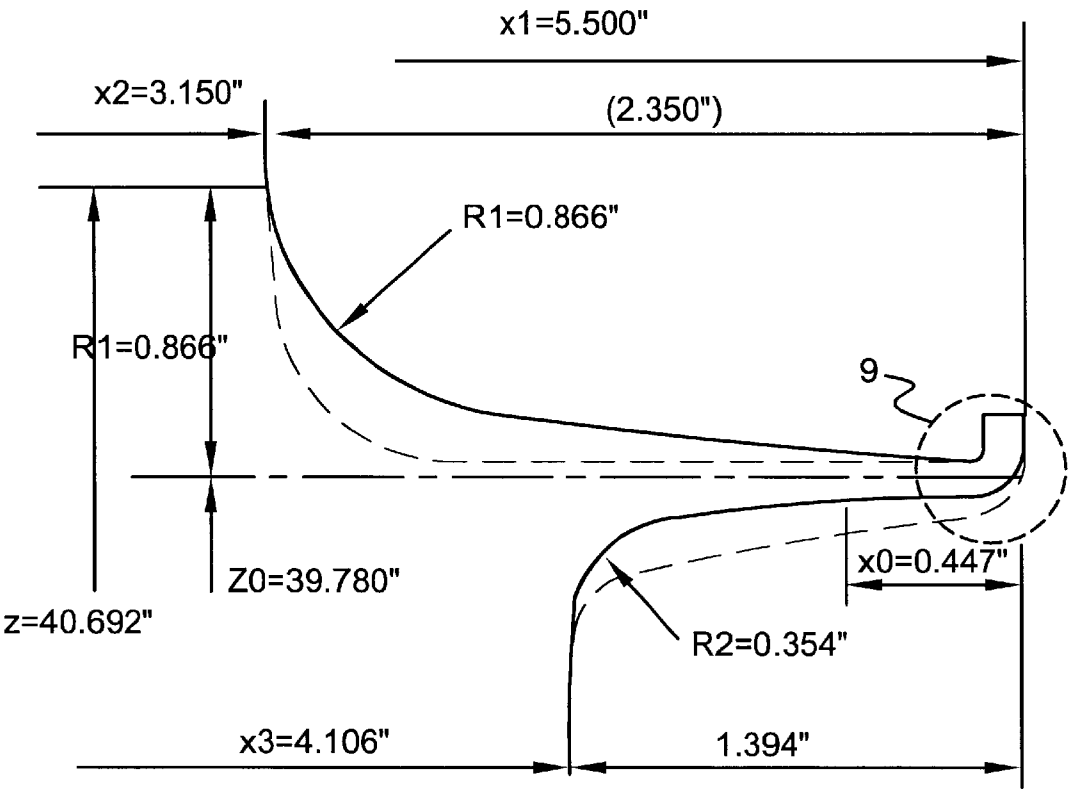
FIG. 8 is a representation of a specific profile body constructed in accordance with a preferred embodiment of the present invention.
Figure 10:
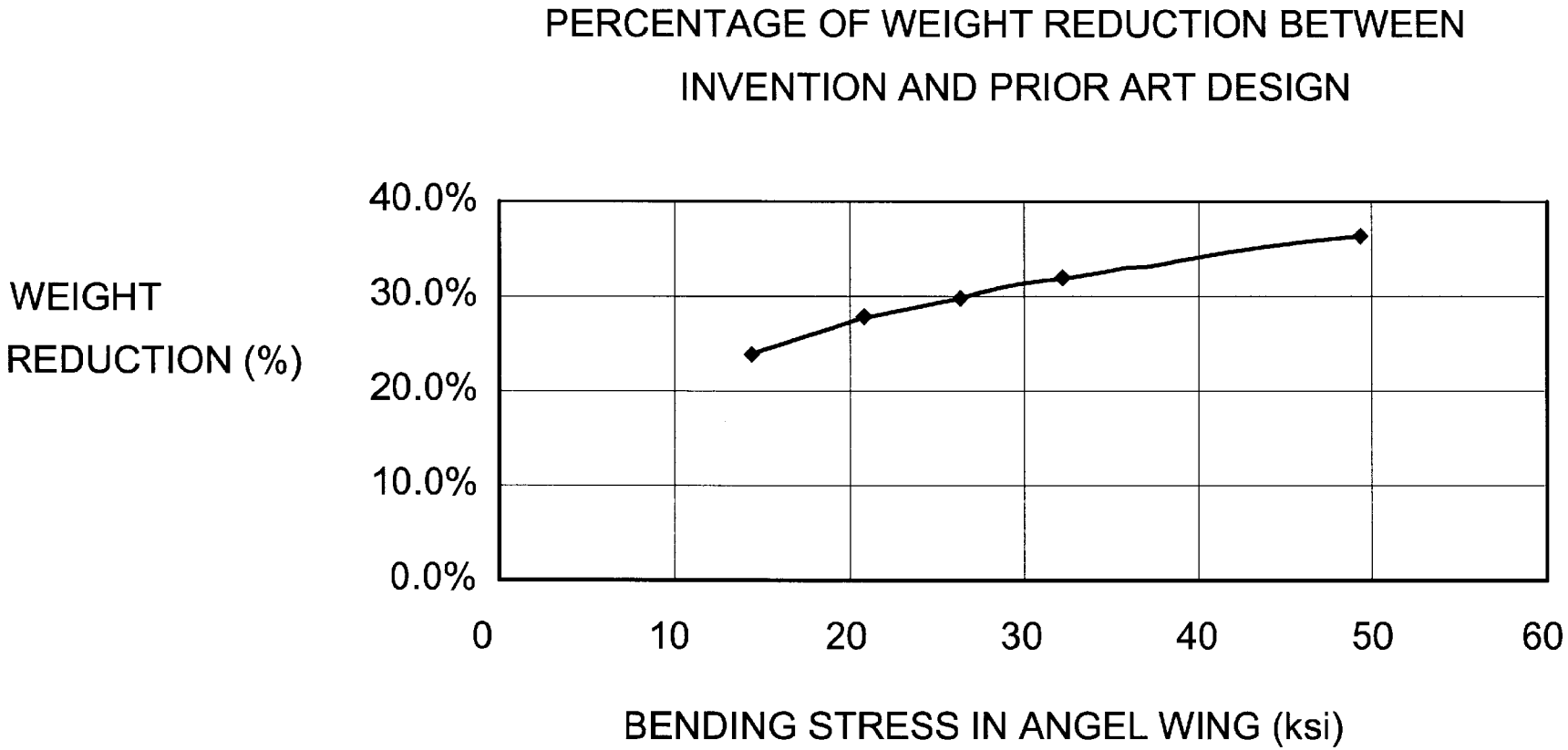
FIG. 10 is a chart illustrating a weight comparison of an example of a present angel wing and a conventional angel wing.

FIG. 8 shows a typical profile determined through the above scheme compared with the profile based on the prior art design illustrated by the dashed lines. FIG. 10 shows the weight savings of the profiled design of FIG. 8 versus the prior art design when the stresses in both designs are kept the same. It can be seen from the figure that the designs disclosed in this invention can generally enable 30% to 40% weight savings. Weight savings are generally more pronounced as the allowable stresses increase.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine having a rotor rotatable about an axis, blades carried by said rotor for rotation therewith and nozzles, a seal between each rotor blade and nozzles for inhibiting ingestion of hot gas from a hot gas flow through the turbine into turbine wheel spaces, comprising:

a seal body extending from a shank of said blade to a cantilevered tip thereof and generally axially toward lands on the nozzles;

said seal body having radially outer and inner surfaces, each including a root fillet and surface portions between said fillet and said tip;

one of said radially outer and inner surface portions extending non-linearly and disposed between said fillet and said tip.

2. A seal according to claim 1 wherein another of said radially inner and outer surface portions of said seal body is non-linear between said fillet and said tip.

3. A seal according to claim 1 wherein said one surface includes a linearly extending surface therealong between said tip and said non-linear extending surface portions.

4. A seal according to claim 1 wherein said seal body has an axis extending parallel to the axis of the rotor, said radial outer surface being coincident with or extending outwardly of the body axis.

5. A seal according to claim 1 wherein said seal body has an axis extending parallel to the rotor axis, said non-linear surface portion forming part of the outer surface at a location radially outwardly of the seal body axis.

6. A seal according to claim 1 wherein said seal body has an axis extending parallel to the rotor axis, said non-linear surface portion forming part of the inner surface at a location radially inwardly of the seal body axis.

7. A seal according to claim 1 wherein said body has an axis extending parallel to the rotor axis, said outer surface lying parallel to the seal body axis and the non-linear surface portion forming part of the inner surface.

8. A seal according to claim 1 wherein said seal body has an axis extending parallel to the rotor axis, said inner surface portion lying parallel to the seal body axis and the non-linear surface portion forming part of the outer surface.

9. A seal according to claim 1 wherein said seal body has an axis extending parallel to the axis of the rotor, each of said outer and inner surfaces having a non-linear surface portion between respective fillets of said inner and outer surfaces and said tip and lying on radially opposite sides of the seal body axis.

10. A seal according to claim 1 wherein said seal body is curved in a circumferential direction about said rotor axis.

11. A seal according to claim 1 wherein the tip terminates in an upturn and the total thickness of the seal body conforms to the equation:

$$h=h_{min} x \leq x_o$$

$$h_{i+1} = h_i + \frac{h_{\min}}{\lambda_1^2 h_i}\left(\sqrt{\lambda_1^2+\lambda_2^2} + \frac{H_{sum}^{(i)}}{h_{\min}^2}\Delta x\right)\Delta x \qquad x > x_o$$

wherein $$x_o = \left(\sqrt{\lambda_1^2+\lambda_2^2} - \lambda_2\right)h_{\min}$$

$$\lambda_1 = \sqrt{\frac{S_{all}}{3h_{\min} z_0 \rho \omega^2}}$$

$$\lambda_2 = \frac{ab}{h_{\min}^2}$$

$$H_{sum}^{(i)} = \sum_{k=0}^{i} h_k = h_0 + h_1 + h_2 + \ldots + h_i$$

$$\Delta x = (L - x_0)/n$$

and wherein $Z_0$ is the radial location of the seal body centerline relative to the axis of rotation of the rotor;

ω is the angular velocity of said rotor;

ρ is the density of material forming said seal body;

a is the width of said upturn;

b is the height of said upturn;

x is the distance from the tip in a direction parallel to the rotor axis to a location measured from the tip;

$H_{sum}^{(i)}$ is the summation of the thicknesses of said seal body at the iterative points h at each distance x;

L is the axial length of the seal body; and n is the number of points used to calculate the thickness and, hence, profile of the seal body.

12. The seal according to claim 11 wherein the profile of said outer surface portion conforms to the equation $$h_{u_i} = \frac{h_{\min}}{2} + \alpha(h_i - h_{\min})$$

wherein $h_{u_i}$ is the height of the outer surface portion relative to a bisector of the minimum section $h_{min_i}$;

$h_i$ is the total thickness at each distance x from the tip;

α is a proportional parameter to locate the upper and lower surfaces relative to the seal body centerline; and;

$h_{min}$ is the minimum thickness of the angel wing.

13. A seal according to claim 11 wherein the profile of said inner surface portion conforms to the equation $$h_{l_i} = \frac{-h_{\min}}{2} - (1-\alpha)(h_i - h_{\min})$$

and wherein $h_{l_i}$ is the height of the outer surface portion relative to a bisector of the minimum section $h_{min_i}$;

$h_i$ is the total thickness at each distance x from the tip;

α is a proportional parameter to locate the upper and lower surfaces relative to the body centerline; and $h_{min}$ is the minimum thickness of the angel wing.

14. In a gas turbine having a rotor rotatable about an axis, blades carried by said rotor for rotation therewith, nozzles and seals between each rotor blade and the nozzles for inhibiting ingestion of hot gas from a hot gas flow path through the turbine into turbine wheel spaces, each said seal having an upturn at a cantilevered tip thereof, a method of determining a profile of the seal, comprising the steps of:

for a given radial location of the seal relative to said rotor axis, material density of the seal, rotational velocity of the rotor, and thickness and width of the seal, determining a thickness profile along a length of the seal to maintain stresses along the seal below a predetermined allowable stress and to reduce the weight of the seal to a minimum.

15. In a gas turbine having a rotor rotatable about an axis, blades carried by said rotor for rotation therewith, nozzles and seals between each rotor blade and the nozzles for inhibiting ingestion of hot gas from a hot gas flow path through the turbine into turbine wheel spaces, each said seal having an upturn at a cantilevered tip thereof, a method of determining a profile of the seal, comprising the steps of:

for a given radial location of the seal relative to said rotor axis, material density of the seal, rotational velocity of the rotor, and thickness and width of the seal, determining the maximum bending stress at selected locations along a length of the seal body; and determining a thickness profile along a length of the seal body having minimum weight for said determined maximum bending stress or an allowable bending stress less than the maximum bending stress.

16. In a gas turbine having a rotor rotatable about an axis, blades carried by said rotor for rotation therewith, nozzles and seals between each rotor blade and the nozzles for inhibiting ingestion of hot gas from a hot gas flow path through the turbine into turbine wheel spaces, each said seal having an upturn at a cantilevered tip thereof, a method of determining a profile of the seal, comprising the steps of:

for a given radial location of the seal relative to said rotor axis, material density of the seal, rotational velocity of the rotor, and thickness and width of the seal, determining the maximum bending stress $S_{max}$ at selective locations along a length of the seal conforming to the equation $$S_{\max} = \frac{6z_0\rho\omega^2}{h^2(x)}\left[ab\left(x - \frac{a}{2}\right) + \int_0^x h(\xi)(x-\xi)\,d\xi\right]$$

wherein the mass of the seal is determined by $$M_a = \rho W\left(ab + \int_0^L h(x)\,dx\right)$$

and wherein $Z_0$ is the radial location of the seal body centerline relative to the axis of rotation of the rotor;

ω is the angular velocity of said rotor;

ρ is the density of material forming said seal body;

a is the width of said upturn;

b is the height of said upturn;

x is the distance from a tip of the seal in a direction parallel to the rotor axis to a location measured from the tip;

$H_{sum}^{(i)}$ is the summation of the thicknesses of said seal body at the iterative points h at each distance x;

L is the axial length of the seal body; and n is the number of points used to calculate the thickness and, hence, profile of the seal body.

17. A method according to claim 16 including determining a profile of the radially outer surface of the seal in conformance with the following equation $$h_{u_i} = \frac{h_{\min}}{2} + \alpha(h_i - h_{\min})$$

wherein $h_{u_i}$ is the height of the outer surface portion relative to a bisector of the minimum section $h_{min_i}$;

$h_i$ is the total thickness at each distance x from the tip;

α is a proportional parameter to locate the upper and lower surfaces relative to the body centerline; and I is an iterative series of x distances from the tip of said seal used during the iterative process.

18. A seal in accordance with claim 16 including determining a profile of the radially inner surface of the seal in conformance with the following equation $$h_{l_i} = \frac{-h_{\min}}{2} - (1-\alpha)(h_l - h_{\min})$$

and wherein $h_{l_i}$ is the height of the inner surface portion relative to a bisector of the minimum section $h_{min_i}$;

$h_1$ is the total thickness at each distance x from the tip;

$h_{min}$ is the minimum thickness of the seal body; and

α is a proportional parameter to locate the upper and lower surfaces relative to the body centerline.

19. A seal according to claim 16 including determining a profile of the radially outer surface of the seal in conformance with the following equation $$h_{u_i} = \frac{h_{\min}}{2} + \alpha(h_i - h_{\min})$$

wherein $h_{u_i}$ is the height of the outer surface portion relative to a bisector of the minimum section $h_{min_i}$;

$h_1$ is the total thickness at each distance x from the tip; and $h_{min}$ is the minimum thickness of the seal body;

α a proportional parameter to locate the upper and lower surfaces relative to the body centerline;

including determining a profile of the radially inner surface of the seal in conformance with the following equation $$h_{l_i} = \frac{-h_{\min}}{2} - (1-\alpha)(h_l - h_{\min})$$

and wherein $h_{l_i}$ is the height of the outer surface portion relative to a bisector of the minimum section $h_{min_i}$;

$h_1$ is the total thickness at each distance x from the tip; and $h_{min}$ is the minimum thickness of the seal body; and α a proportional parameter to locate the upper and lower surfaces relative to the body centerline.

* * * * *